US005785881A

United States Patent [19]

Puckace

[11] Patent Number: 5,785,881

[45] Date of Patent: Jul. 28, 1998

[54] OIL SOLUBLE COMPLEXES OF PHOSPHORUS-FREE STRONG MINERAL ACIDS USEFUL AS LUBRICATING OIL ADDITIVES

[75] Inventor: James Stanley Puckace, Perrineville, N.J.

[73] Assignee: Exxon Chemical Comapny, Linden, N.J.

[21] Appl. No.: 353,012

[22] Filed: Dec. 9, 1994

[51] Int. Cl.[6] ..... C10M 159/00

[52] U.S. Cl. ..... 252/46.3; 252/48.2; 252/49; 252/51.5 R; 252/52 R; 252/54

[58] Field of Search ..... 252/48.21, 46.31, 252/49, 51.5 R, 54, 52 R

[56] References Cited

U.S. PATENT DOCUMENTS

| | | | |
|---|---|---|---|
| 2,952,636 | 9/1960 | Groot et al. | 252/49 |
| 4,031,023 | 6/1977 | Musser et al. | 252/48.2 |
| 4,338,205 | 7/1982 | Wisotsky | 252/46.3 |
| 4,764,299 | 8/1988 | Salomon | 252/48.2 |
| 4,889,646 | 12/1989 | Vettel | 252/32.7 |
| 5,338,470 | 8/1994 | Hiebert et al. | 252/51.5 |

*Primary Examiner*—Jerry D. Johnson
*Attorney, Agent, or Firm*—T. J. Shatynski

[57] ABSTRACT

This invention provides oil-soluble complexes of oil-insoluble phosphorus-free strong mineral acids and alcohols. The complexes are useful antiwear additives in lubricating oils, particularly automatic transmission fluids.

12 Claims, No Drawings

OIL SOLUBLE COMPLEXES OF PHOSPHORUS-FREE STRONG MINERAL ACIDS USEFUL AS LUBRICATING OIL ADDITIVES

BACKGROUND OF THE INVENTION

1. Field of the Invention

This invention concerns oil soluble complexes of phosphorus-free strong mineral acids useful as additives in lubrication oils, particularly automatic transmission fluids ("ATF").

2. Description of Related Art

It is well known that phosphorus- and sulfur-containing compounds are useful as antiwear additives in lubricating oils. Traditionally these materials are made soluble in oleaginous media by forming reaction products of phosphorus acids and oxides with long chain ($C_{10}$ to $C_{20}$) alcohols or amines. Examples of this are shown in U.S. Pat. No. 5,185,090 where short chain ($C_2$ to $C_4$) phosphites are transesterified with longer chain alcohols (thioalcohols) and mixtures of alcohols (thioalcohols) to give oil soluble products. Co-pending U.S. application Ser. No. 168,840, filed Dec. 17, 1993 now U.S. Pat. No. 5,443,774, discloses that $P_2O_5$ reacted with alcohols (thioalcohols) yield oil soluble products. It is also known that sulfur may be solubilized through reaction with fatty esters or olefins.

I have now found alternate phosphorus-free antiwear additives which are stable and quite potent. In particular, mineral acids of sulfur such as sulfurous and sulfuric acids can be solubilized by dissolving them at low temperatures in alcohols, particularly in alcohols that contain ether or thioether linkages. Once the alcohol and the acidic material are complexed, the acid remains completely soluble. These non-aqueous solutions of strong mineral acids allow their addition to lubricating oil additive concentrates or lubricating oils without violent exothermic reactions. The strong antiwear properties of these additives are demonstrated by FZG load stage failures in the range of 11 to 13.

SUMMARY OF THE INVENTION

One embodiment of this invention relates to an oil-soluble additive, wherein the additive comprises the complex of a substantially oil-insoluble phosphorus-free strong mineral acid and an alcohol, the alcohol being a single alcohol or mixtures of alcohols represented by (I) or (II), where (I) and (II) are:

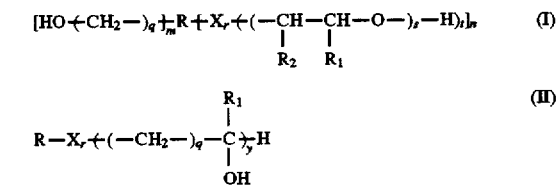

(I)

(II)

where:

m+n is an integer from 1 to 4;

m is 0 or an integer from 1 to 4;

n is 0 or an integer from 1 to 4;

q is 0 or an integer from 1 to 6;

R is a $C_1$–$C_{50}$ hydrocarbyl group in structure (I), and is a $C_1$–$C_{50}$ hydrocarbyl group or hydrogen in structure (II);

X is sulfur, oxygen, nitrogen, or —$CH_2$—;

r is 0, or an integer from 1 to 5 providing when X is oxygen or nitrogen, r is 1, when X is sulfur, r is 1 to 3, when X is —$CH_2$—, r is 1 to 5;

s is 0, or an integer from 1 to 12;

t is 0, or an integer from 1 to 2 providing when X is sulfur, oxygen, or —$CH_2$—, t is 1, when X is nitrogen, t is 1 or 2;

y is 0, or an integer from 1 to 10; and $R_1$ and $R_2$ are independently a $C_1$–$C_6$ alkyl or hydrogen.

In another embodiment, this invention concerns a lubricating oil composition comprising a lubrication oil basestock and an antiwear effective amount of this invention's additive.

A further embodiment of this invention relates to a method of inhibiting wear in lubricating oil systems, including power transmission fluid systems, and particularly automatic transmission fluid systems.

Yet another embodiment of this invention relates to the method of forming the complex.

DETAILED DESCRIPTION OF THE INVENTION

Phosphorus-Free Strong Mineral Acids

Suitable phosphorus-free strong mineral acids include those which are oil-insoluble or substantially oil-insoluble. The term substantially oil-insoluble is meant to include those acids whose limited solubility would be improved by following the teachings of this disclosure.

Generally, these strong mineral acids are classified as acids containing a hydrogen dissociating moiety having a pKa from about −12 to about 4, preferably from about −8 to about 3, most preferably from about −4 to about 3. The term pKa is defined as the negative base 10 logarithm of the equilibrium dissociation constant of the acid in an aqueous solution measured at 25° C. The pKa values reported herein are based on the values reported in "Lange's Handbook of Chemistry", Thirteenth Edition, 1985.

Suitable phosphorus-free mineral acids are chlorosulfonic acid ($HOSO_2Cl$; pKa=−10.4), hydrogen bromide (HBr; pKa=9.0), hydrogen chloride (HCl; pKa=−6.1), hydrogen flouride (HF; pKa=3.2), hydrogen iodide (HI; pKa=−9.5), iodic acid ($HIO_3$; pKa=0.80), nitric acid ($HNO_3 \cdot 3H_2O$; pKa=−1.4), perchloric acid ($HClO_4 \cdot 3H_2O$; pka=−4.8 and $HClO_4 \cdot 7H_2O$; pKa=−2.1), sulfuric acid ($H_2SO_4$; pKa=−3.0), sulfurous acid ($H_2SO_3$; pKa=1.9), and trithiocarbonic acid (20°) ($H_2CS_3$; pKa=2.7). Sulfuric and sulfurous acids are preferred, with sulfuric acid the most preferred.

Alcohols

The alcohols represented by structures I and II form a broad description of alcohols useful in this invention. It should be noted that the hydrocarbyl groups represented by R may be straight-chained, branched, or cyclic. Representative hydrocarbyl groups within this definition include alkyl, alkenyl, cycloalkyl, aralkyl, alkaryl, aryl, and their hetero-containing analogs.

Among the suitable alcohols within structure (I) are alkoxylated alcohols ($s \geqq 1$) and alkoxylated polyhydric alcohols ($s \geqq 1$ and $m+n+t \geqq 2$), and mixtures thereof.

Examples of particularly useful alkoxylated alcohols are nonyl phenol pentaethoxylate, pentapropoxylated butanol, hydroxyethyloctyl sulfide, and diethoxylated dodecyl mercaptan.

Examples of particularly useful alkoxylated polyhydric alcohols are oleyl amine tetraethoxylate, 5-hydroxy-3-thio butanol triethoxylate, thiobisethanol, diethoxylated tallow amine, dithiodiglycol, tetrapropoxylated cocoamine, diethylene glycol, and 1,7-dihydroxy-3,5-dithioheptane.

Among the suitable alcohols within structure (II) are the polyhydric alcohols ($y \geqq 2$). Examples of particularly useful polyhydric alcohols are pentaerythritol, 1-phenyl-2,3 propane diol, polyvinyl alcohol, 1,2-dihydroxy hexadecane and 1,3-dihydroxy octadecane.

A particularly useful combination of alcohols are those represented by (III), (IV), and mixtures thereof, where (III) and (IV) are:

$$A—OH \quad \text{(III)}$$

and $$OH—B—OH \quad \text{(IV)}$$

where:

$$A \text{ is } \underset{\underset{X_1}{|}}{\overset{\overset{Y_1}{|}}{CH}}—(OCH_2CH_2)_r— \text{ or } Y_1—\underset{\underset{X_1}{|}}{CH}—(OCH_2\underset{\underset{CH_3}{|}}{CH}—)_s—;$$

$X_1$ is H or $R_2SCH_2—$;

$$Y_1 \text{ is } R_2SCH_2—,\ R_2S\underset{\underset{CH_3}{|}}{CH}CH_2—,\ R_2S\underset{\underset{\underset{CH_3}{|}}{CH_2}}{\overset{|}{CH}}CH_2—,$$

$$R_2S\underset{\underset{CH_3}{|}}{CH}—,\ R_2SCH_2\underset{\underset{CH_3}{|}}{CH}—,\ \text{or } R_2SCH_2\underset{\underset{\underset{CH_3}{|}}{CH_2}}{\overset{|}{CH}}—;$$

s is 0 or an integer from 1–12;

B is $—CH_2CH_2SCH_2CH_2—$, $—CH_2CH_2SSCH_2CH_2—$ or $$R_3\underset{|}{C}HCH_2SR_4—;$$

and $R_2$ and $R_3$ are the same or different and are H or a hydrocarbyl group containing up to 50 carbon atoms. $R_4$ is a hydrocarbyl group containing up to 50 carbon atoms.

The $R_2$, $R_3$, and $R_4$ groups of the alcohols (III) and (IV) are hydrocarbyl groups which may be straight-chained, branched, or cyclic. Representative hydrocarbyl groups include alkyl, alkenyl, cycloalkyl, aralkyl, alkaryl, and their hetero-containing analogs.

The hetero-containing hydrocarbyl groups may contain one or more hetero atoms. A variety of hetero atoms can be used and are readily apparent to those skilled in the art. Suitable hetero atoms include, but are not limited to, nitrogen, oxygen, phosphorus, and sulfur. Preferred hetero atoms are oxygen and sulfur, with sulfur atoms the most preferred.

When the hydrocarbyl group is alkyl, straight-chained alkyl groups are preferred—typically those that are about $C_2$ to $C_{18}$, preferably about $C_4$ to $C_{12}$, most preferably about $C_6$ to $C_{10}$ alkyl. When the hydrocarbyl group is alkenyl, straight-chained alkenyl groups are preferred—typically those that are about $C_3$ to $C_{18}$, preferably about $C_4$ to $C_{12}$, most preferably about $C_6$ to $C_{10}$ alkenyl. When the hydrocarbyl group is cycloalkyl, the group typically has about 5 to 18 carbon atoms, preferably about 5 to 16, most preferably about 5 to 12. When the hydrocarbyl group is aralkyl and alkaryl, the aryl portion typically contains about $C_6$ to $C_{12}$, preferably 6 carbon atoms, and the alkyl portion typically contains about 0 to 18 carbon atoms, preferably 1 to 10.

Straight-chained hydrocarbyl groups are preferred over branched or cyclic groups. However, if the hydrocarbyl group constitutes the less preferred cycloalkyl group, it may be substituted with a $C_1$ to $C_{18}$ straight-chained alkyl group, preferably $C_2$ to $C_8$.

Representative examples of suitable hydrocarbyl groups for alcohols (III) and (IV) include methyl, ethyl, propyl, butyl, pentyl, hexyl, heptyl, octyl, 2-ethylhexyl, isooctyl, tertiary-octyl, nonyl, isononyl, tertiary-nonyl, secondary-nonyl, decyl, isodecyl, undecyl, dodecyl, tridecyl, palmityl, stearyl, isostearyl, octenyl, nonenyl, decenyl, dodecenyl, oleyl, linoleyl and linolenyl, cyclooctyl, benzyl, octylphenyl, dodecylphenyl, and phenyloctyl.

The preferred hydrocarbyl groups for alcohol (III) are hexyl, octyl, decyl, and dodecyl. The preferred hydrocarbyl groups for alcohol (IV) are, for $R_3$: methyl, ethyl, and propyl; and, for $R_4$: methylene, ethylene, propylene, and isopropylene.

Alcohols (III) and (IV) may be prepared by conventional methods widely known in the art. For example, a thioalcohol is produced by oxyalkylation of a mercaptan containing the desired hydrocarbyl group. Suitable oxyalkylating agents include alkylene oxides such as ethylene oxide, propylene oxide, butylene oxide, and mixtures thereof. The most preferred alkylene oxide is ethylene oxide. Thus, the preferred thioalcohol may be prepared by the following reaction equation:

$$RSH + \text{Ethylene Oxide} \rightarrow RSCH_2CH_2OH \quad \text{(V)}$$

where R is defined above.

To produce the desired alcohol, a more preferred reaction route is:

$$RCH{=}CH_2 + HSR_2OH \rightarrow RCH_2CH_2SR_2OH \quad \text{(VI)}$$

wherein R and $R_2$ are described above. Reaction equation (VI) is preferred because it yields a higher percentage of the desired alcohol whereas reaction equation (V) may produce a single alcohol of the formula $RS(CH_2CH_2O—)_n—H$, where $n>1$, or a mixture of alcohols where $n>1$ and varies.

Complex Formation

The relative proportions of the mineral acid and alcohol in forming the complex may widely vary providing the complex is oil soluble. Thus, the following examples are not intended to limit the relative amounts of mineral acid to alcohol.

An example of this invention is illustrated below:

$$\text{(a) } A—OH + \text{(b) } OH—B—OH + H_2SO_4 \rightarrow \text{Complex} \quad \text{(VII)}$$

where A and B are defined above, and $1 \leqq a+2b \leqq 6$.

A preferred complex of this invention is formed by a monoalcohol and may be represented by the following equation:

$$\text{(a) } RSCH_2CH_2OH + H_2SO_4 \rightarrow \text{Complex} \quad \text{(VIII)}$$

where R is defined above.

Typically, the complexing of mineral acid and alcohol is carried out under atmospheric pressure and at temperatures ranging from about −10 to 65, preferably 20 to 55, most preferably 25° to 40° C. At these temperatures, a complex is formed without producing water. At temperatures over 65° C. water may be produced and this evidences that an etherification reaction has occurred. Products prepared between −10° and 65° C. temperatures make it less likely that a reaction will occur. Complexing times range from about 0.5 to about 4 hours. Sufficient complexing can typically be achieved in about two hours.

One method of forming the complex is first to dissolve the appropriate amount of the mineral acid in water. The acid may be purchased as an aqueous concentrate, i.e., 70% in water, thereby eliminating the dissolution step. The alcohols (or thioalcohols) are then added to the aqueous solution of acid and the temperature raised to the desired level with stirring until a homogeneous mixture is produced.

After the mineral acids and alcohols have sufficient time to complex, it may be desirable to remove water, i.e., water that may have been used to dissolve the acid. The water may be removed at atmospheric pressure or the complex may be placed under vacuum to remove water. Stripping times and temperatures vary according to the desired degree of stripping. The vacuum can range from about −65 to about −90 kPa, stripping times from about 1 to about 2 hours, and temperatures from 50° to 65° C. Typically, sufficient water removal may be achieved at a vacuum of about −60 kPa which is maintained for about 1 hour at 55° C.

A second method of forming a stable complex is to dissolve the anhydrous acid in the alcohol mixture. It is sometimes desirable to then add a small amount of water to the blend. Typically, 1–5 weight percent of water will give a stable homogeneous material.

The complexes shown in equations (VI) and (VII) may be added to a lubricating oil basestock in an amount sufficient to impart antiwear properties. The typical range is 0.05 to 2.0 weight percent of 100% active ingredient, preferably 0.2 to 1.0 weight percent, most preferably 0.4 to 0.7 weight percent.

It may be desirable to include a source of boron with the complex of this invention in the lubrication oil basestock. The presence of boron tends to lessen the deterioration of silicone-based seals. The boron source may be present in the form of borated dispersants, borated amines, borated alcohols, borated esters, or alkyl borates.

Accordingly, by adding an effective amount of this invention's complex to a lubricating oil and then placing the resulting lubrication oil within a lubrication system, the oil will inhibit wear in metal-to-metal contact as well as in metal-to-nonmetal contact (i.e., nonmetal composites: paper/phenolic resins, graphite/paper/phenolic resins, KEVLAR®/paper resins, etc.).

The lubrication oil basestock may contain one or more additives to form a fully formulated lubricating oil. Such lubricating oil additives include corrosion inhibitors, detergents, pour point depressants, antioxidants, extreme pressure additives, viscosity improvers, friction modifiers, and the like. These additives are typically disclosed in, for example, "Lubricant Additives" by C. V. Smalheer and R. Kennedy Smith, 1967, pp. 1–11 and in U.S. Pat. No 4,105,571, the disclosures of which are incorporated herein by reference. A fully formulated lubricating oil normally contains from about 1 to about 20 weight % of these additives. Borated or unborated dispersants may also be included as additives in the oil, if desired. However, the precise additives used (and their relative amounts) will depend upon the particular application of the oil. Contemplated applications for formulations of this invention include passenger car motor oils, gear oils, industrial oils, lubricating oils, and power transmission fluids, especially automatic transmission fluids and tractor hydraulic fluids. The following list shows representative amounts of additives in lubrication oil formulations:

| Additive | (Broad) Wt. % | (Preferred) Wt. % |
|---|---|---|
| VI Improvers | 1–12 | 1–4 |
| Corrosion Inhibitor/ Passivators | 0.01–3 | 0.01–1.5 |
| Anti-Oxidants | 0.01–5 | 0.01–1.5 |
| Dispersants | 0.10–10 | 0.1–8 |
| Anti-Foaming Agents | 0.001–5 | 0.001–1.5 |
| Detergents | 0.01–6 | 0.01–3 |
| Anti-Wear Agents | 0.001–5 | 0.001–1.5 |
| Pour Point Depressants | 0.01–2 | 0.01–1.5 |
| Seal Swellants | 0.1–8 | 0.1–6 |
| Friction Modifiers | 0.01–3 | 0.01–1.5 |
| Lubricating Base Oil | Balance | Balance |

Particularly suitable detergent additives for use with this invention include ash-producing basic salts of Group I (alkali) or Group II (alkaline) earth metals and transition metals with sulfonic acids, carboxylic acids, or organic phosphorus acids.

Particularly suitable types of antioxidant for use in conjunction with the complex of this invention are the amine-containing and hydroxy aromatic-containing antioxidants. Preferred types of these antioxidants are alkylated diphenyl amines and substituted 2,6 di-t-butyl phenols.

The complex of this invention may also be blended to form a concentrate. A concentrate will generally contain a major portion of the complex together with other desired additives and a minor amount of lubrication oil or other solvent. The complex and desired additives (i.e., active ingredients) are provided in the concentrate in specific amounts to give a desired concentration in a finished formulation when combined with a predetermined amount of lubrication oil. The collective amounts of active ingredient in the concentrate typically are from about 0.2 to 50, preferably from about 0.5 to 20, most preferably from 2 to 20 weight % of the concentrate, with the remainder being a lubrication oil basestock or a solvent.

The complex of this invention may interact with the amines contained in the formulation (i.e., dispersant, friction modifier, and antioxidant) to form quaternary ammonium salts. The formation of amine and quaternary ammonium salts, however, will not greatly affect the antiwear characteristics of this invention.

Suitable lubrication oil basestocks can be derived from natural lubricating oils, synthetic lubricating oils, or mixtures thereof. In general, the lubricating oil basestock will have a viscosity in the range of about 5 to about 10,000 $mm^2/s$ (cSt) at 40° C., although typical applications will require an oil having a viscosity ranging from about 10 to about 1,000 $mm^2/s$ (cSt) at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g., dodecylbenzenes, tetradecylbenzenes, dinonylbenzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers, and their derivatives where the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500); and mono- and poly-carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, di-ethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicone-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hex-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydroforans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

This invention may be further understood by reference to the following examples which are not intended to restrict the scope of the appended claims.

PREPARATIVE EXAMPLES

Example 1

In a one liter flask equipped with a stirrer, water condenser, thermometer, an addition funnel and a dry ice trap 190 g (1 mole) of octylthioethanol and 122 g (1 mole) of thiobisethanol were placed. The mixture of alcohols was cooled to near 0° C. and 98 g (1 mole) of $H_2SO_4$ is added dropwise. After the addition is completed, the mixture was stirred for appoximately 1 hour. A homogeneous clear liquid was obtained containing approximately 23.7% S.

Example 2

In a one liter flask equipped with a stirrer, water condenser, thermometer, an addition funnel and a dry ice trap 380 g (2 moles) of octylthioethanol and 122 g (1 mole) of thiobisethanol were placed. The mixture of alcohols was cooled to near 0° C. and 98 g (1 mole) of $H_2SO_4$ was added dropwise. After the addition is completed, the mixture was stirred for appoximately 1 hour. A homogeneous clear liquid was obtained containing approximately 21.5% S.

Example 3

In a one liter flask equipped with a stirrer, water condenser, thermometer, an addition funnel and a dry ice trap 190 g (1 mole) of octylthioethanol and 154 g (1 mole) of dithiodiglycol were placed. The mixture of alcohols was cooled to near 0° C. and 98 g (1 mole) of $H_2SO_4$ was added dropwise. After the addition was complete, the mixture was stirred for approximately one hour. A homogeneous clear liquid was obtained containing approximately 29.3% S.

The stability of the samples of Examples 1 to 3 was assessed by examining the samples stored at room temperature for at least 90 days. All samples remained clear with no separation evident.

PERFORMANCE EXAMPLES

The antiwear performance of the additives of this invention is illustrated by the following examples.

Three mineral oil formulations, A–C, containing the additives of Examples 1–3, respectively, were prepared. Two comparative fluids, D and E, were used. Formulation D was a "blank" ATF formulation containing no antiwear additive while E was the reference base oil used in all the formulations.

Formulations A–D were prepared using the same lubrication oil basestock, E, and the same amounts of dispersant, antioxidant, friction modifier, seal swellant, antifoamant, and viscosity modifier. The amounts of these additives remained the same for Formulations A–D so that the effect of this invention's additives could be quantified in each formulation.

Formulations A–E were run in the FZG Gear Test, according to the DIN 51354 (Germany) test procedure. Accordingly, the gear set was run using each tests formulation at increasing load stages until scoring of the tooth flank occurred. Therefore, failure of a formulation at higher load stages is desirable. Results of this test are:

FZG GEAR TEST

| F[1] | Nonphosphorus-Containing Additive | % By Wt.[2] | Stage Failure |
|---|---|---|---|
| A | EXAMPLE 1 | 0.5 | 11 |
| B | EXAMPLE 2 | 0.5 | 12 |
| C | EXAMPLE 3 | 0.5 | 13[3] |
| D | None-BLANK ATF | — | 7 |
| E | None-BASE OIL | — | 5 |

[1]F = Formulation.
[2]Weight percent of total formulation.
[3]Maximum load stage possible.

The results of this test indicate that the formulations containing the additives of this invention gave better results than Formulation D, the blank ATF, and Formulation E, the base oil. More importantly, the results of this test illustrate that the additives of this invention are capable of providing potent antiwear performance in the absence of phosphorus as evidenced by the high FZG load stages measured.

What is claimed is:

1. An oil-soluble additive wherein the additive comprises the complex of a substantially oil-insoluble phosphorus-free strong mineral acid and an alcohol formed at a temperature ranging from about −10° to 65° C., the alcohol being a single alcohol or mixtures of alcohols represented by (I) or (II), where (I) and (II) are:

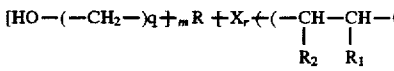

(I)

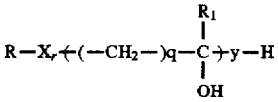

(II)

where:

m+n is an integer from 1 to 4;

m is 0 or an integer from 1 to 4;

n is 0 or an integer from 1 to 4;

q is 0 or an integer from 1 to 6;

R is a $C_1$–$C_{50}$ hydrocarbyl group in structure (I), and is a $C_1$–$C_{50}$ hydrocarbyl group or hydrogen in structure (II);

X is sulfur, oxygen, nitrogen, or —$CH_2$—;

r is 0, or an integer from 1 to 5 providing
when X is oxygen or nitrogen, r is 1,
when X is sulfur, r is 1 to 3,
when X is —$CH_2$—, r is 1 to 5;

s is 0, or an integer from 1 to 12;

t is 0, or an integer from 1 to 2 providing
when X is sulfur, oxygen, or —$CH_2$—, t is 1,
when X is nitrogen, t is 1 or 2;

y is 0, or an integer from 1 to 10; and $R_1$ and $R_2$ are independently a $C_1$–$C_6$ alkyl or hydrogen.

2. The additive of claim 1, wherein the strong mineral acid has a pKa from about −8 to about 3 in aqueous solutions measured at 25° C.

3. The additive of claim 2, wherein the strong mineral acid is $H_2SO_3$ or $H_2SO_4$.

4. The additive of claim 3, wherein the alcohol is selected from the group consisting of (III), (IV), and mixtures thereof, where (III) and (IV) are:

A—OH (III)

and

OH—B—OH (IV)

where:

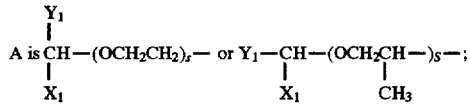

$X_1$ is H;

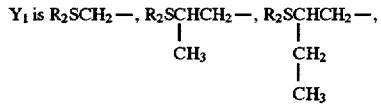

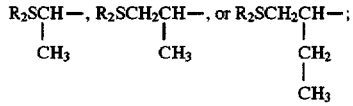

s is 0 or an integer from 1–12;

B is —$CH_2CH_2SCH_2CH_2$—, or —$CH_2CH_2SSCH_2CH_2$— or

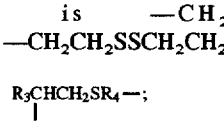

where $R_2$ is a $C_1$ to $C_{50}$ hydrocarbyl group, $R_3$ is H or a $C_1$ to $C_6$ hydrocarbyl group; and $R_4$ is a $C_1$ to $C_{50}$ hydrocarbyl group.

5. The additive of claim 4 where (III) and (IV) are mixed with the acid in the molar ratio of alcohol to acid of 1:1 to 6:1, and the amount of (III) is at least twice the amount of (IV).

6. The additive of claim 5, where $R_2$, $R_3$, and $R_4$ represent alkyl, alkenyl, cycloalkyl, aralkyl, or alkaryl.

7. The additive of claim 6, where A is $R_2SCH_2CH_2$—, $R_2$ is a $C_1$–$C_{15}$ alkyl.

8. A lubricating oil composition comprising a major amount of lubricating oil basestock and an antiwear effective amount of the complex of claim 1.

9. A concentrate composition comprising 0.2 to 50 weight percent based on active ingredient of the complex of claim 1.

10. A method of forming the complex of claim 1, wherein the acid and alcohol are mixed at a temperature from about −10° C. to 65° C.

11. An oil-soluble additive wherein the additive comprises the complex of a substantially oil-insoluble phosphorus-free strong mineral acid and an alcohol formed at a temperature ranging from about −10° to 65° C., wherein the alcohol is selected from the group consisting of (III), (IV), and mixtures thereof, where (III) and (IV) are:

A—OH (III)

and

OH—B—OH (IV)

where:

$$A \text{ is } \begin{array}{c} Y_1 \\ | \\ CH \\ | \\ X_1 \end{array} -(OCH_2CH_2)_s- \text{ or } Y_1-\underset{\underset{X_1}{|}}{CH}-(OCH_2\underset{\underset{CH_3}{|}}{CH}-)_s-;$$

$X_1$ is $R_2SCH_2-$;

$$Y_1 \text{ is } R_2SCH_2-,\ R_2S\underset{\underset{CH_3}{|}}{CH}CH_2-,\ R_2S\underset{\underset{\underset{CH_3}{|}}{CH_2}}{|}CH_2-,$$

$$R_2S\underset{\underset{CH_3}{|}}{CH}-,\ R_2SCH_2\underset{\underset{CH_3}{|}}{CH}-,\ \text{or } R_2SCH_2\underset{\underset{\underset{CH_3}{|}}{CH_2}}{|}CH-;$$

s is 0 or an integer from 1–12;

B is $-CH_2CH_2SCH_2CH_2-$, $-CH_2CH_2SSCH_2CH_2-$ or $$R_3\underset{\underset{|}{}}{CH}CH_2SR_4-;$$

where $R_2$ and $R_3$ are the same or different and are H or a hydrocarbyl group containing up to 50 carbon atoms; and $R_4$ is a hydrocarbyl group containing up to 50 carbon atoms.

12. The additive of claim 11, wherein the strong mineral acid is $H_2SO_3$ or $H_2SO_4$.

* * * * *